United States Patent [19]

Francis et al.

[11] Patent Number: 4,844,459

[45] Date of Patent: Jul. 4, 1989

[54] SCRUMMAGE TRAINER

[76] Inventors: Timothy D. Francis; Derek R. De Glanville, both of Collacott, Kings Nympton, Umberleigh, North Devon EX37 9TP, England

[21] Appl. No.: 125,779

[22] Filed: Nov. 27, 1987

Related U.S. Application Data

[63] Continuation of Ser. No. 908,299, Sep. 17, 1986, abandoned, which is a continuation of Ser. No. 582,010, Feb. 21, 1984, abandoned.

[51] Int. Cl.[4] ..... A63B 67/00

[52] U.S. Cl. ..... 273/55 R; 273/1 R

[58] Field of Search ..... 273/55 R; 272/54, 123, 272/142

[56] References Cited

U.S. PATENT DOCUMENTS

| | | | |
|---|---|---|---|
| 800,434 | 9/1905 | Fairbanks | 272/54 |
| 2,558,081 | 6/1951 | Gnrdenhour | 273/55 R |
| 2,581,302 | 1/1952 | Schmechel | 272/54 |
| 2,967,709 | 1/1961 | Stahley | 273/55 R |
| 3,326,553 | 8/1967 | Rogers | 273/55 R |
| 3,425,692 | 2/1969 | Leach | 273/55 R |
| 3,674,265 | 7/1972 | Sheets | 273/55 R |
| 3,709,645 | 1/1973 | Thorson | 272/54 |
| 3,804,410 | 4/1974 | Gilman | 273/55 R |
| 3,827,690 | 8/1974 | Rogers | 273/55 R |
| 3,873,089 | 3/1975 | Krug | 273/55 R |
| 3,942,796 | 3/1976 | Bowen | 273/55 R |
| 4,451,037 | 5/1984 | O'Hare | 273/55 R |

FOREIGN PATENT DOCUMENTS

| | | | |
|---|---|---|---|
| 2337563 | 9/1977 | France | 273/55 R |
| 2031737 | 4/1980 | United Kingdom | 273/55 R |

*Primary Examiner*—Richard C. Pinkham
*Assistant Examiner*—T. Brown
*Attorney, Agent, or Firm*—William R. Hinds

[57] ABSTRACT

A trainer comprising a framework designed to offer resistance against being pushed and training pad-carrying members provided with pads against which players in a scrummage may push, each such pad including at least one position for engagement by a shoulder of a player and a raised horizontal portion by the head and neck of the player so that he can push upwards against it, the members being resiliently movable vertically.

9 Claims, 4 Drawing Sheets

SCRUMMAGE TRAINER

Figure 1:
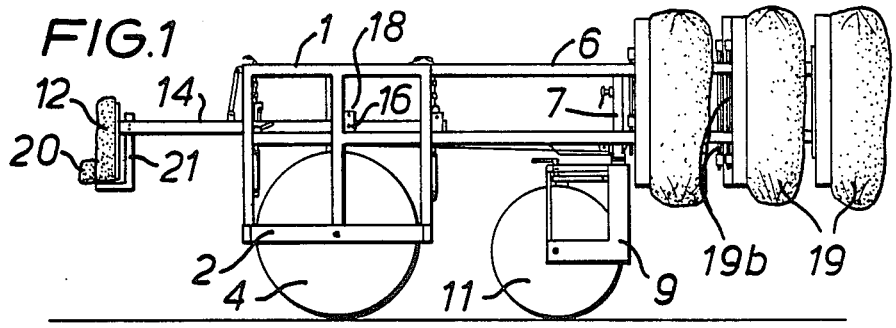

This application is a continuation of Ser. No. 980,299 filed Sept. 17,1986, and now abandoned, which is a continuation of Ser. No. 582,010 filed Feb. 21, 1984, now abandoned.

This invention relates to training apparatus for preparing players for the game of Rugby football, referred to hereinafter as a trainer.

In the past the only apparatus in common use for scrummage training has been a framework mounted on skids with fixed padding for the scrummage team to push against and incorporating a platform for weights to be added, usually in the form of people, as many as fifteen or so at a time. The scope of this apparatus is limited, it requires a large number of people to work it, and it tends to damage the grass on which it is used. Moreover it can only be used conveniently by players of more or less the same size, not by adults and children.

According to one aspect of the present invention a trainer comprises a framework designed to offer resistance to being pushed, and having pad-carrying members provided with pads against which players in a scrummage can push, the pads including a vertical portion or portions for engagement by one or more shoulders of a player and an upper horizontal portion against which the head and neck of the player can push upwards to provide an exercise that will develop back and neck muscles. Preferably the trainer is carried by a suspension system that includes a castor action support at the end opposite to that where pushing is taking place. This enables the characteristic wheeling action of a scrummage to be simulated and resistance to this may be made variable by changing the castor action. The upward movement or downward movement of the pads preferably starts from a zero position which is adjustable to suit the stature of the individual players and takes place against a progressively increasing resistance which may be produced by springs. The pads may also be adjustable laterally to suit the physique of individual players and preferably consist of a pair of pads, for the two props, the right hand one having an upper transverse portion for neck and back exercise and strengthening, and a pair of vertical portions to complete a U shaped structure to simulate the shoulders of the left hand prop and hooker of the opposing front row, while the left hand one has a transverse upper portion but only one vertical portion which simulates the shoulder of the opposing right hand prop.

According to another aspect of the invention a trainer may be provided, with or without the features referred to above, with a set of hollow rollers by which it is supported from the ground, the resistance to motion being provided either by ballasting the rollers by partly or fully filling them with a heavy fluid such as sand or water, or by providing a brake acting on one or more of the rollers, or both. This virtually eliminates the damage to the pitch which can be caused by conventional trainers. Should the resistance provided by this means prove inadequate for example if the ground is unusually hard, side foot plates can be provided so that other players can stand on the trainer to increase its resistance.

Figure 2:
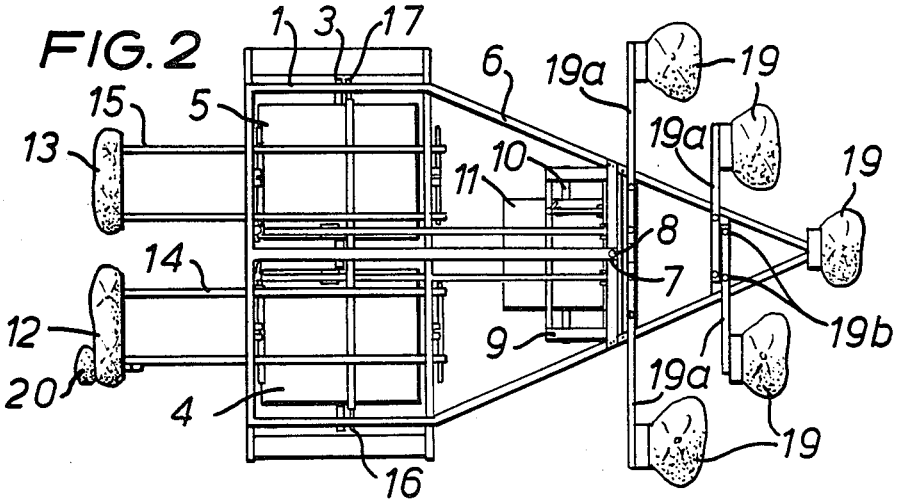
Figure 6:
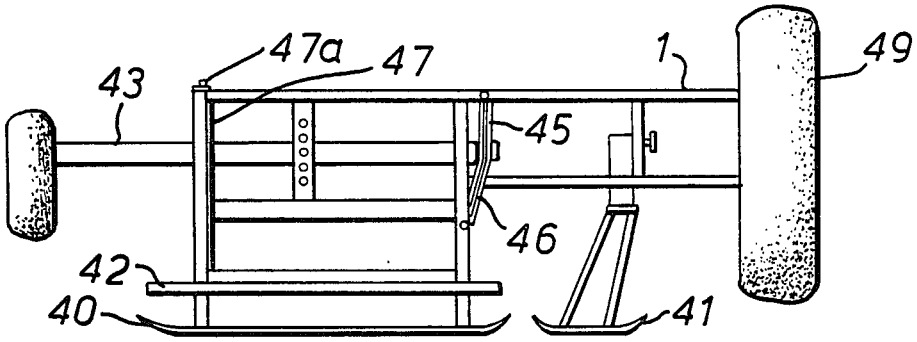
Figure 3:
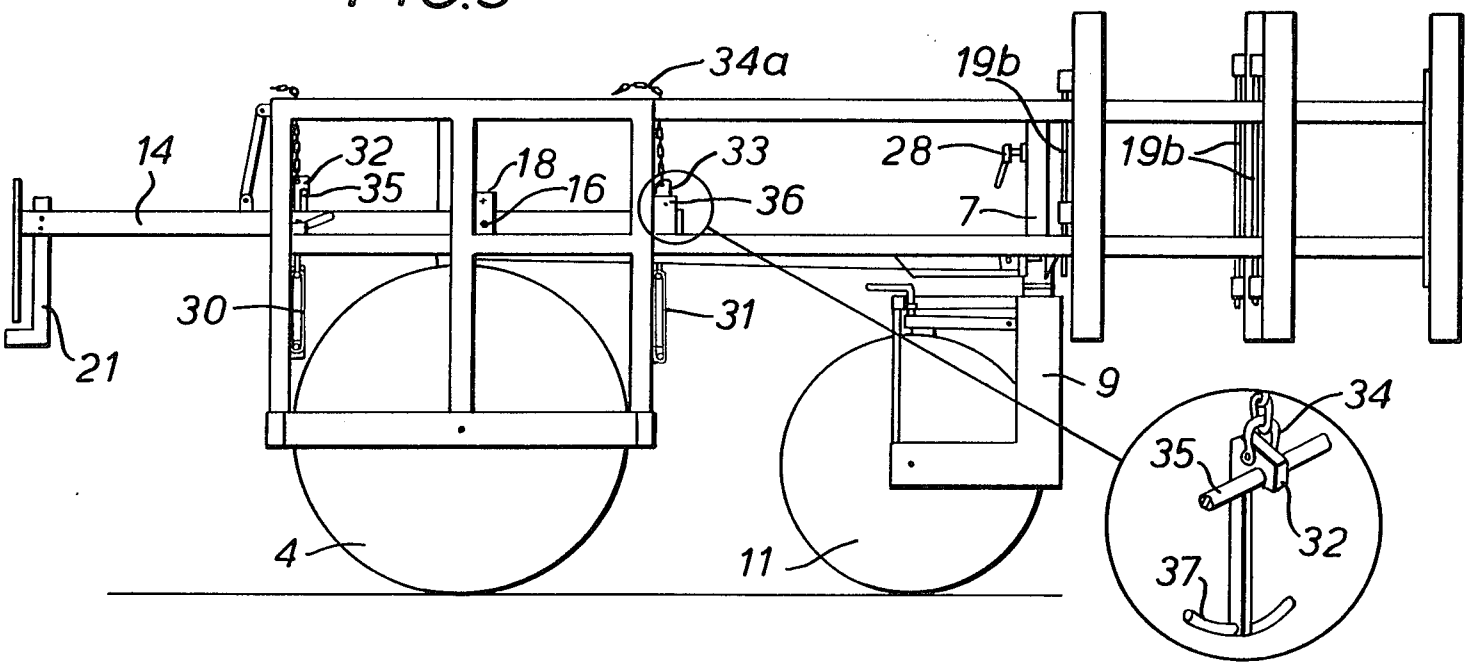
Figure 4:
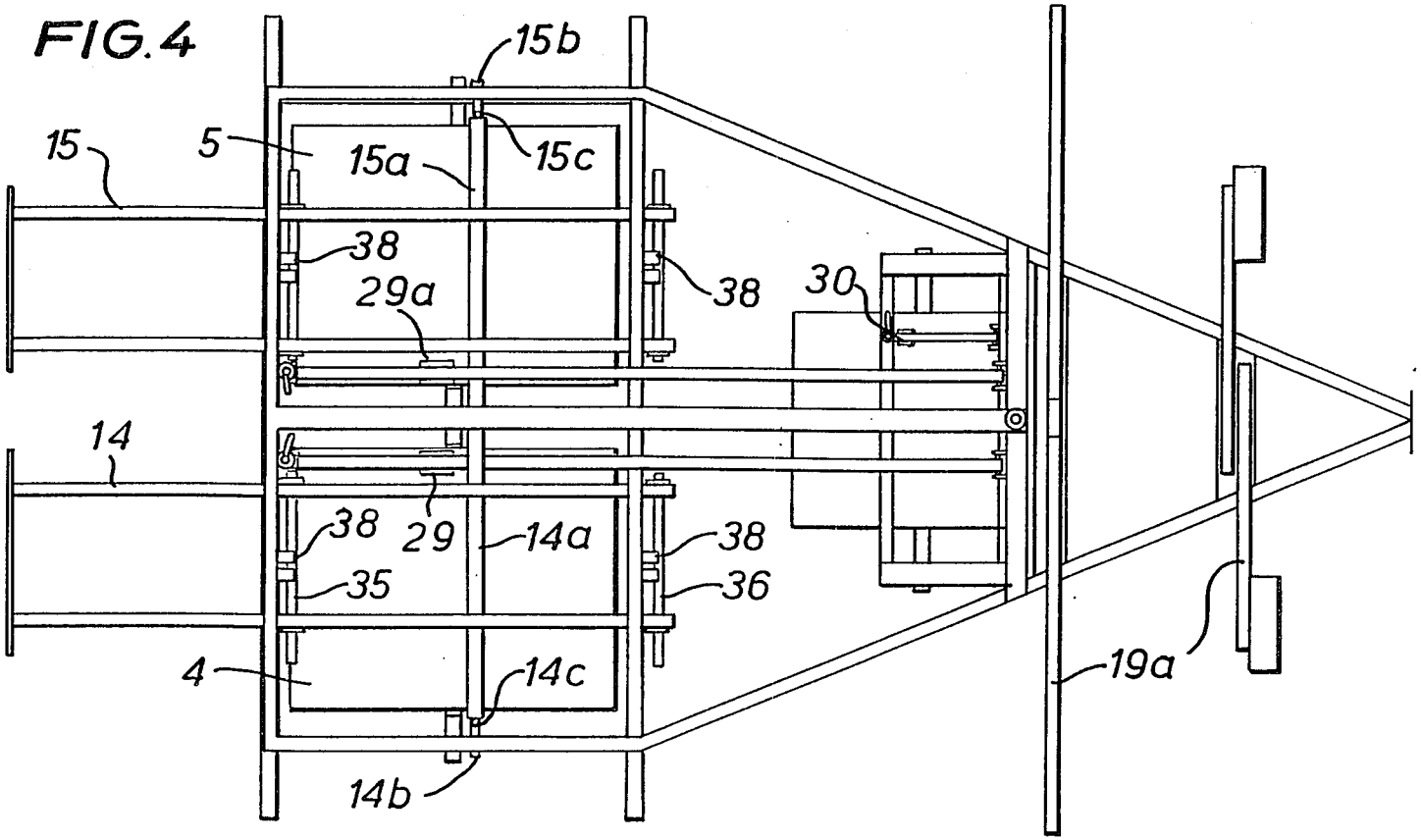
Figure 5:
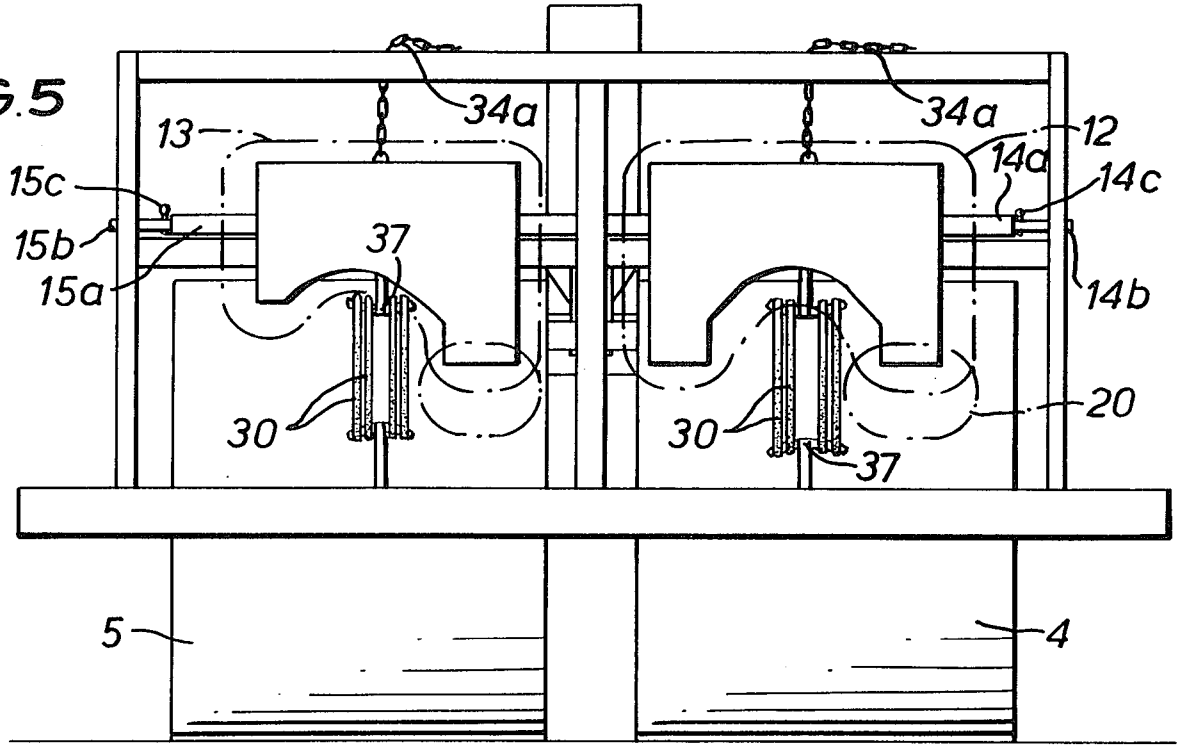
Figure 4:
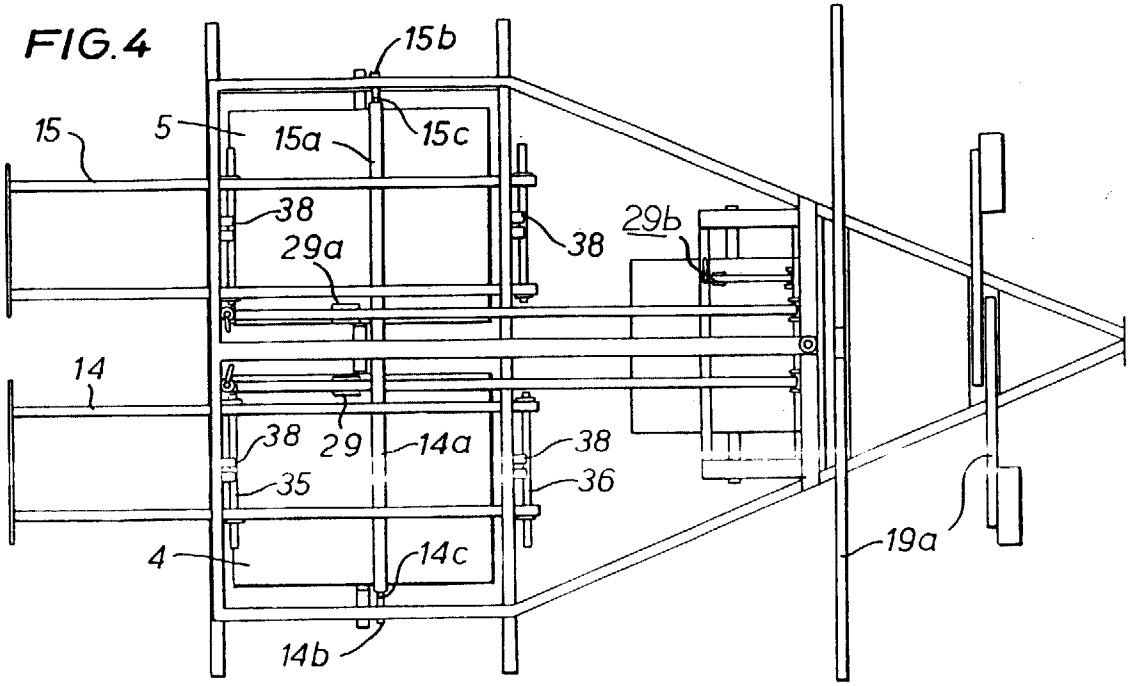

Other features of the invention will appear from the following description taken in conjunction with the accompanying drawing in which:

FIG. 1 is a side elevation of one form of roller-mounted trainer in accordance with the invention, FIG. 2 is a plan view of the same, FIGS. 3 and 4 are corresponding views on a larger scale with the pads omitted, FIG. 5 is an end elevation of the rear of the trainer and FIG. 6 is a side elevation of an alternative skid-mounted version of the trainer shown in FIG. 1.

Referring first to FIGS. 1 and 2 it will be seen that the trainer comprises a frame 1, which may be constructed of welded steel tube, has a pair of side members 2 in which is located an axle 3 (FIG. 2) for two independently journalled ground rollers 4 and 5. An extension 6 of the frame 1 extends away from the opposite end of it and has a head tube 7 in which is journalled a pivot pin 8 (FIG. 2) which carries a sub-frame 9 having an axle 10 FIG. 2) for a further roller 11.

A pair of pushing pads 12 and 13 are arranged at one end of the trainer and are carried by sub-frames 14 and 15 which are pivoted on fulcrum pins 16 and 17 inserted through uprights 18 attached to the frame 1.

The frame 1 is triangulated at its opposite end 6 and carries a number of bolster-like pads 19 for use in practising rucking and mauling. These are preferably arranged as shown in an echelon formation and for protection of the players additional padding (not shown) is provided on the front and sides of the triangulated portion of the frame and also on the front of the sub-frame 9.

The pads 19 are constructed on laterally extending bars 19a which are conveniently attached to the trainer by pins 19*b* which are inserted through holes in the bars 19*a* and holes in cross members of the frame 1.

An optional dummy head 20 may be attached to one of the frames 14 by a bracket 21 to simulate for example the head of the left prop of the opposing side and this may be extended sideways if desired to simulate his outside shoulder.

Other details of the construction are more clearly seen in FIGS. 3, 4 and 5.

As will be seen the pad 12 on the right of the trainer is in the shape of an inverted U, the two vertical limbs of which simulate the adjacent shoulders of the left prop and the hooker of the opposing side. The pad 13 however is in the shape of an inverted L the single vertical limb of which simulates the right shoulder of the right prop of the opposing side.

The sub-frame 9 trails castor-wise behind the pivot pin 8 which can be locked to the main frame 1 by a clamp screw 28. If desired, an adjustable friction device or damper can be used to restrain the tendency of the sub-frame 9 to rotate.

In use, the trainer can be set up to match different statures of player by adjustment of the vertical and horizontal positions of the pads 12 and 13. The resistance to motion of the trainer can be varied by filling the rollers 4, 5 and 11, which are hollow, to a chosen degree with a heavy fluid such as water or sand. Additional resistance may be provided, if required, by brake pads 29 and 29*a* which act by means of screwjacks as shown on the two rollers 4 and 5, and by brake pad 29*b* which acts in a similar way on the roller 11. The jacks can be operated independently, so that one or other roller may be locked to cause wheeling to take place. The brake pads are simple friction blocks carried by beams pivoted on the respective frames. The rollers may be plain, or if additional grip on the ground is necessary they may be ribbed or studded.

As will be seen from FIGS. 3, 4 and 5 the frames 14 and 15 each have a welded-on tube 14*a* and 15*a* respectively and these form pivots on rods 14*b* and 15*b* attached to the frame 1. The tubes 14*a* and 15*a* are shorter than the distance between the frame members and are held to one side by pins 14*c* and 15*c* through the rods 14*b* and 15*b*. When it is desired to change the lateral spacing of the pads 12 and 13 the pins are withdrawn, the tubes shifted outwards and the pins replaced in further holes near the other end of the rods 14*b* and 15*b*. If more adjustment positions are required the tubes may be made shorter and extra pins and holes used.

Spring biasing of the frames 14 and 15 is provided by loops of shock cord 30 and 31 and these are each arranged to operate only in one direction by being attached to a hook member 32 and 33 respectively. The arrangement of these hook members is shown in the detail of FIG. 3, where one of them is shown in perspective. Here it will be seen that each hook has a top shackle 34 by which it is attached to a chain 34*a* and that it hooks over a rod 35 (or 36) which extends across the frame 14 (or 15) and carries at its lower end an anchor-shaped bar 37, to which the loops of shock cord may be easily attached. Thus the springing can be easily adjusted by adding or removing shock cords as required. Each of the chains is, in use, held in a claw 38 (seen in FIG. 4 without the chains and hooks), so that this takes the pull of the springs when the frames 14 and 15 are in the zero position. As soon as the frames are moved up or down however, the pre-tension of the appropriate spring is immediately effective since the appropriate rod 35 or 36 will engage the hook 32 or 33. The frame 15 is similarly arranged.

The fact that each of the pads 12 and 13 has an upper horizontal portion enables the coach to include exercises that will develop and strengthen the back and neck muscles to the point where the risk of injury in these areas during play is substantially reduced. Moreover, the resistance to upward or downward movement can be controlled by adjustment of the springs to suit the physique and state of development reached by the individual player.

The use of a steerable roller 11 at the front of the trainer permits the device to be set, when the roller 11 is locked at a selected angle, to initiate a wheeling action of the players being trained, or if it is not so set but a predetermined resistance to turning is applied to the pivot pin 8, as by using a hydraulic damper, resistance to wheeling by an opposing team can be simulated. Alternatively the brakes on the rollers 4 and 5 can be differentially applied to assist in training under such conditions. The front roller pivot pin 8 can however be left free so that resistance to wheeling is imposed merely by the natural resistance to turning of the front roller, or if desired the front roller can be locked in a straight ahead position so that wheeling is prevented altogether.

Generally speaking, in simulating actual scrummage conditions, the left hand prop will attempt to keep up so that the hooker gets as clear a view as possible of the ball as it comes in, while the right hand prop will attempt to bear down, so that if the ball is thrown in from that side the opposing hooker's view will be impaired as far as possible. The dummy head 20 assists the prop in bearing down when this is required.

If a less expensive form of trainer is required it can be constructed in the form shown in FIG. 6, which shows a machine similar to that previously described, but instead of rollers it is mounted on skids 40 at the back and a castor action skid 41 at the front. The brakes of the previous construction will, of course, be omitted and it will be necessary to add weight for resistance purposes by having persons stand on the foot boards 42. The other features of the previously described construction are included in a simplified form. The rear pads are shown supported on beams 43 and 44 which in this case have two opposing sets of shock cord 45 and 46 at the front end. Vertical adjustment of the pads is by changing the pivot pins to different holes in the frame and lateral adjustment may be achieved by shifting sideways a pair of vertically slotted frames 47 arranged at the back of the frame 1. These can be held in position by pins 47*a*. A single, or a pair of pads 49 may be provided at the front of the trainer for practising rucking and mauling.

It will be seen that the invention provides a trainer of considerable versatility, capable of simulating actual playing conditions and in the case of the version mounted on rollers, one which will cause a minimum of damage to turf on which it is used.

We claim:

1. A scrummage trainer comprising: a ground-mobile frame having means to resist movement thereof over the ground, at least one pad carrier mounted on said frame to pivot relatively thereto about a substantially horizontal axis transverse to the direction of movement of said ground-mobile frame; pads on said carrier, for abutment by trainees, providing portions for shoulder engagement by trainees and further portions for head and neck engagement by trainees; and spring means operatively connected between said frame and said pad carrier and arranged to progressively increasingly resist pivotal movement of said pad carrier in at least one direction about said horizontal axis, wherein said spring means are first spring means arranged to resist pivotal movement of said pad carrier in one direction about said horizontal axis and second spring means are provided operatively connected between said frame and said pad carrier and are arranged to progressively increasingly resist pivotal movement of said pad carrier in the opposite direction to said one direction about said horizontal axis.

2. A trainer as defined in claim 1, wherein said first spring means are arranged to be operated by said pad carrier when pivoted in said one direction and not to be operated by said pad carrier when pivoted in said opposite direction; and said second spring means are arranged to be operated by said pad carrier when pivoted in said opposite direction and not to be operated by said pad carrier when pivoted in said one direction.

3. A trainer as defined in claim 2, wherein said first and second spring means are each a tension spring and one-way acting connection means are provided between each tension spring and said frame or said pad carrier; each said one-way acting connection means being arranged to prevent movement of the respective tension spring away from said frame or said pad carrier and permit movement of said respective tension spring towards said frame or said pad carrier.

4. A trainer as defined in claim 1, wherein said ground-mobile frame is carried by a pair of ground-engaging rollers located proximate said pad carrier and by at least one other ground-engaging roller pivotally mounted on said frame to have a castor action and located remote from said pad carrier and differential braking means are provided for said pair of rollers whereby a wheeling action can be imposed on said trainer.

5. A trainer as defined in claim 4, wherein further braking means, independent of said differential braking means, are provided for said other roller.

6. A trainer as defined in claim 1 wherein said ground-mobile frame is carried by a pair of ground-engaging skids located proximate said pad carrier and by at least one other ground-engaging skid pivotally mounted on said frame to have castor action and located remote from said pad carrier.

7. A scrummage trainer comprising: a ground-mobile frame having means to resist movement thereof over the ground, at least one pad carrier mounted on said frame to pivot relatively thereto about a substantially horizontal axis transverse to the direction of movement of said ground-mobile frame; pads on said carrier, for abutment by trainees, providing portions for shoulder engagement by trainees and further portions for head and neck engagement by trainees; and spring means operatively connected between said frame and said pad carrier and arranged to progressively increasingly resist pivotal movement of said pad carrier in at least one direction about said horizontal axis, wherein two pad carriers are provided, one pad carrier having two shoulder engageable pad portions bridged by a head and neck engageable pad portion and the other pad carrier having one shoulder engageable pad portion and a head and neck engageable pad portion, for abutment by the three front row forwards of a trainee scrummage pack.

8. A trainer as defined in claim 7, wherein said shoulder engageable pad portion has a horizontally extended padded projection to mimic the head of an opposing player.

9. A trainer as defined in claim 7 wherein each of said two pad carriers are provided with said spring means whereby each of said two pad carriers can pivot separately about said horizontal axis against individual progressively increasing resistance.

* * * * *

UNITED STATES PATENT AND TRADEMARK OFFICE

CERTIFICATE OF CORRECTION

PATENT NO. : 4,844,459

DATED : July 4, 1989

INVENTOR(S) : TIMOTHY D. FRANCIS AND DEREK R. DeGLANVILLE

It is certified that error appears in the above—identified patent and that said Letters Patent is hereby corrected as shown below:

On Sheet 3 of the drawings comprising Fig. 4, reference numeral "30" is changed to --29b--.

Per attached sheet.

Signed and Sealed this

Tenth Day of March, 1992

*Attest:*

HARRY F. MANBECK, JR.

*Attesting Officer*

*Commissioner of Patents and Trademarks*